United States Patent [19]

Ishikawa

[11] 4,142,639

[45] Mar. 6, 1979

[54] REMOVAL APPARATUS FOR DIE CASTING MACHINE

[75] Inventor: Noritoki Ishikawa, Fuchu, Japan

[73] Assignee: Ryobi, Ltd., Hiroshima, Japan

[21] Appl. No.: 750,337

[22] Filed: Dec. 13, 1976

[30] Foreign Application Priority Data

| | | | |
|---|---|---|---|
| Dec. 15, 1975 | [JP] | Japan | 50-169666[U] |
| Dec. 16, 1975 | [JP] | Japan | 50-169871[U] |
| Dec. 17, 1975 | [JP] | Japan | 50-170898[U] |
| Dec. 17, 1975 | [JP] | Japan | 50-170899[U] |

[51] Int. Cl.[2] ..... B22D 29/00

[52] U.S. Cl. ..... 414/753; 92/31; 92/66; 164/404

[58] Field of Search ..... 214/1 BB, 1 B; 92/31, 92/66, 117 R; 164/344, 401, 404, 405

[56] References Cited

U.S. PATENT DOCUMENTS

| | | | |
|---|---|---|---|
| 230,638 | 8/1880 | King | 214/1 BB |
| 3,428,190 | 2/1969 | Joichi | 214/1 BB |
| 3,760,956 | 9/1973 | Burch | 214/1 BB |

FOREIGN PATENT DOCUMENTS

| | | | |
|---|---|---|---|
| 244085 | 3/1970 | U.S.S.R. | 214/1 BB |

*Primary Examiner*—Francis S. Husar
*Assistant Examiner*—George F. Abraham
*Attorney, Agent, or Firm*—Sughrue, Rothwell, Mion, Zinn and Macpeak

[57] ABSTRACT

An apparatus for removing a casting from a die casting machine and transporting it to a predetermined location comprises a plurality of hydraulic cylinder and piston sets connected in series and arranged in parallel with each other for driving a product gripping and conveying mechanism 30 towards and away from the die casting machine, thereby reducing the installation space and the operating time. Preferably, the apparatus has a turning device 40 for rotating the removed casting, and the gripping and conveying mechanism is inclined from 5 to 20 degrees to facilitate the removal of the casting.

6 Claims, 12 Drawing Figures

REMOVAL APPARATUS FOR DIE CASTING MACHINE

BACKGROUND OF THE INVENTION

1. Field of the Invention

This invention relates to an apparatus for removing a casting from a die casting machine and conveying it to a desired location.

2. Description of the Prior Art

Die casting machines are widely used to produce very smooth, accurate components on a mass production basis. Such a machine supports two die halves, moving one along guide or tie bars into alignment with the other. Pressure is applied to lock and hold the dies together so that no leakage occurs at the seam line, and then molten metal is forced into the die under pressure to form a casting.

For the removal of the casting from the machine and the conveyance thereof to a desired location, industrial robots or similar apparatuses have been used. Such devices include a rod member, a hydraulic cylinder and piston for driving the rod member in reciprocation, and a chuck mechanism connected to one end of the rod member for holding and releasing the casting as desired.

Such a conventional casting removal apparatus employs a rod member driven by only one hydraulic cylinder and piston, whereby its longitudinal dimension is a function of the full rod stroke required for the removal and conveyance of the casting. Consequently, its installation space is relatively large and its floor utility ratio is correspondingly low. Further, it takes a long period of time for the single rod member to travel over its entire stroke for the removal of the casting. This reduces the overall production rate even when a high speed die casting machine(s) is used.

Further, the rod member of the conventional apparatus moves in a horizontal direction to conveniently convey the removed casting to a selected site. This often causes the casting to strike obstacles, such as a core mold assembly, which causes the casting to become flawed or damaged during its removal from the die casting machine. This limits the die casting machine to the production of castings having only a narrow range of shapes, which can be directly removed without blockages.

To prevent the casting from striking obstacles during its removal, means have been provided for moving the gripping mechanism up and down so that the apparatus can move the casting in both the horizontal and vertical directions. This requires either two driving means or a special transmission converting means, however, and both alternatives are complex and costly to manufacture and operate, and are subject to frequent failure and breakdown.

An attempt has been also made to provide a rotating device using a fixed pin in sliding engagement with a spiral groove for turning over the casting held by the gripping mechanism. Such a device can only rotate the casting in one direction, however, and is insufficient for removing a casting which must be rotated in the opposite direction to prevent damage.

SUMMARY OF THE INVENTION

Briefly, and in accordance with the present invention, a travelling carriage rotatably mounts, at an adjustable angle of horizontal inclination from 5 to 20 degrees, a first hydraulic piston and cylinder assembly for extending and retracting a slidable frame member having T-shaped end pieces with guide rods journalled therein. A second hydraulic piston and cylinder assembly is mounted with its cylinder between the end pieces, and its piston rod coupled to a hollow extension arm, whereby the arm can be moved toward and away from a casting machine by the second assembly. A third hydraulic cylinder is mounted to the rear end of the extension arm, and its piston rod extends through the arm to control a casting gripper on the forward end of the arm. The first and second assemblies are mounted parallel to each other to conserve space, and their series extension serves to advance and retract the gripper with respect to a casting machine.

A guide cylinder for the extension arm may also be provided with a Y-shaped cam groove arrangement slidingly engaged by a post on the extension arm, whereby the latter, and with it a gripped casting, may be rotated in a desired direction.

DETAILED DESCRIPTION OF THE PREFERRED EMBODIMENTS

Figure 1:
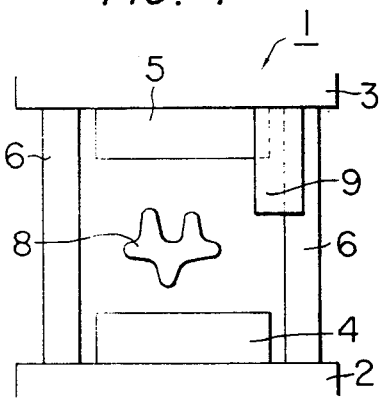
FIG. 1 shows a schematic plan view of a conventional die casting machine with the mold halves thereof shown in an open position.
Figure 2:
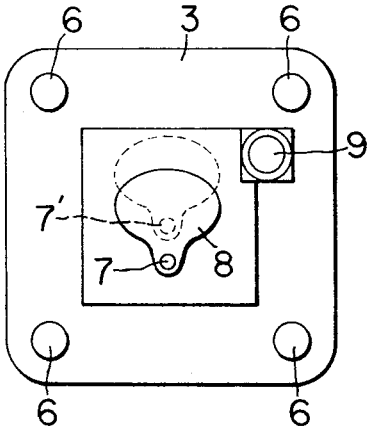
FIG. 2 shows a schematic side view of the die casting machine of FIG. 1.

Referring now to the drawings, and initially to FIGS. 1 and 2, a conventional die casting machine 1 includes a stationary platen 2 bearing a mold half 4 and a movable platen 3 bearing a mold half 5. The platen 3 is movable along tie bars 6 so that the mold half 5 is brought into alignment with the other mold half 4. Pressure is applied to lock and hold the mold halves 4 and 5 together so that no leakage occurs at their juncture line, and molten metal is then forced, under pressure, through a pouring hole 7 into the mold cavity. After the molten metal solidifies to form a casting 8 within the mold cavity, the mold is opened and a push pin simultaneously releases the casting 8. A core assembly 9 is provided in the movable mold half 5 to form a hollow casting.

Figure 3:
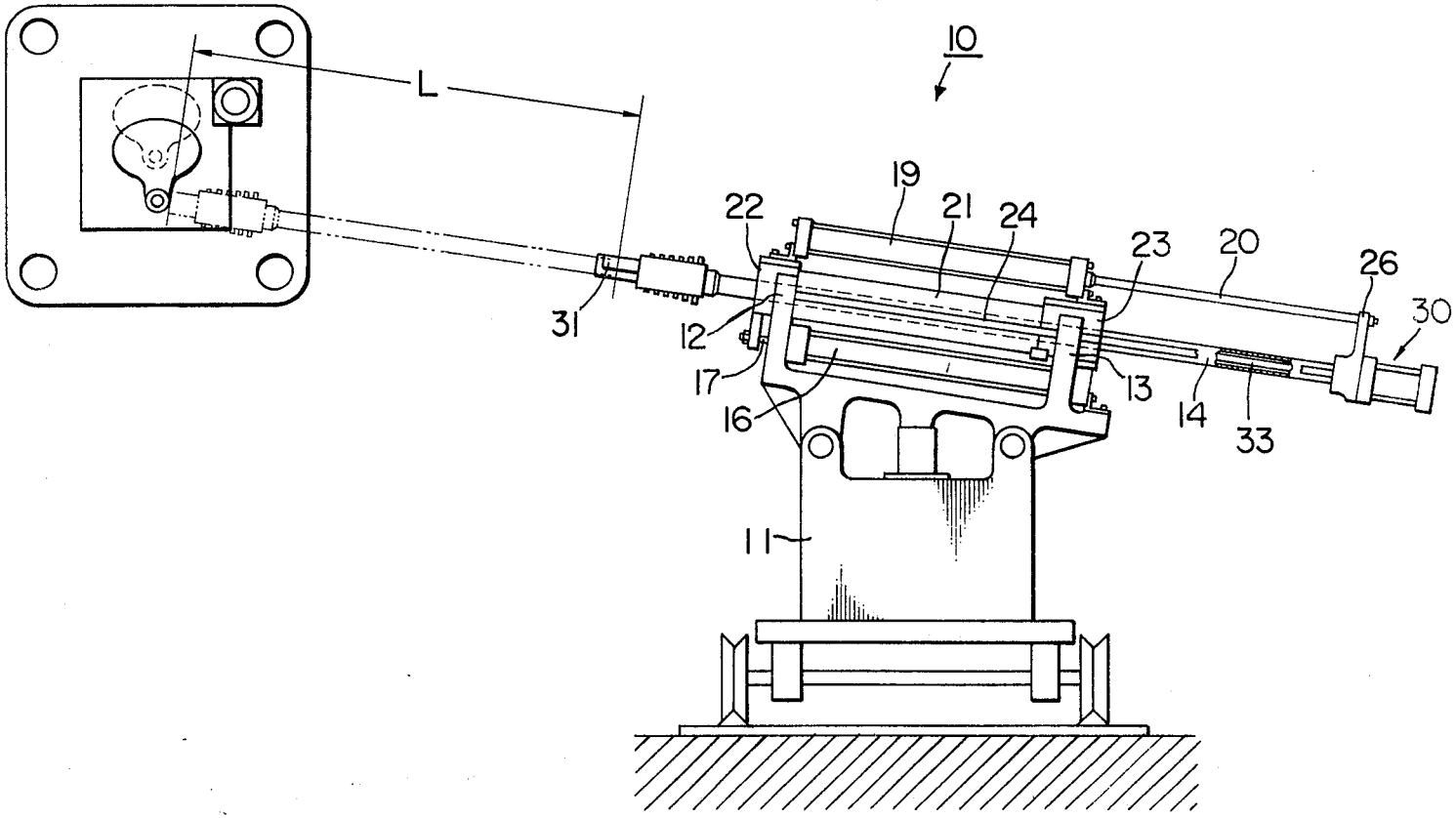
FIG. 3 shows a side view of a casting removal apparatus in accordance with the present invention.
Figure 7:
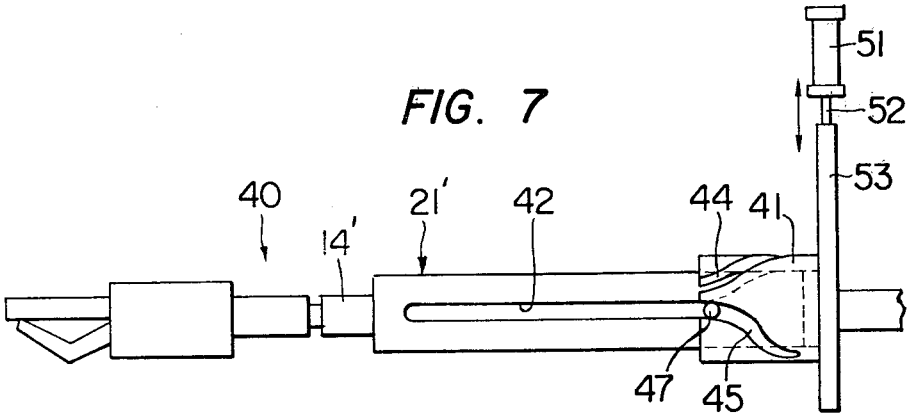
FIG. 7 shows a plan view of a casting turning device associated with the removal apparatus of the invention.
Figure 8:
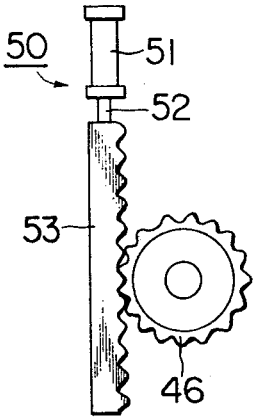
FIG. 8 shows a rear elevation of FIG. 7.

Referring to FIG. 3, a product removing apparatus 10 according to the present invention includes a base 11 and front and rear support frames 12 and 13 mounted to the base, with respect to which a movable pipe member 14 is supported for reciprocation towards and away from the die casting machine 1. The support frames are rotatable with respect to the base, and the latter is mounted on a travelling carriage in a conventional manner. A first hydraulic cylinder and piston set which comprises a cylinder 16 and a piston 17 is connected in parallel with a second hydraulic cylinder and piston set which comprises a cylinder 19 and a piston 20 through a connection pipe member 21 whose ends are provided with front and rear brackets 22 and 23. The cylinder 16 of the first set is fixed to the support frames 12 and 13 in parallel with the movable pipe member 14, and the piston 17 of the first set is connected to the front bracket 22 for reciprocating the connection pipe member 21 on the die casting machine side.

Figure 4:
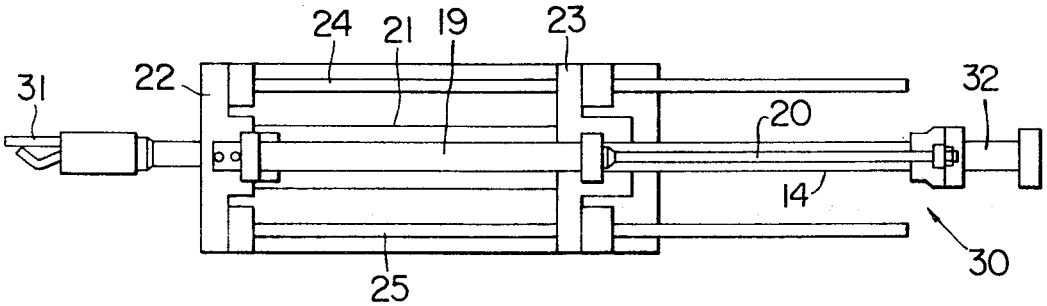
FIG. 4 shows a plan view of the apparatus of FIG. 3.

As shown in FIG. 4, the front bracket 22 has its opposite end portions secured to two support rods 24 and 25, respectively, whose lengths corresponds to the stroke of the piston 17 of the first set and which extend rearwardly through the support frames 12 and 13 for sliding movement therein, thus implementing a reciprocating motion of the connection pipe member 21 relative to the base 11. The second set has its cylinder 19 secured to and between the front and rear brackets 22 and 23, so that the cylinder 19 can be moved in a direction parallel to the movable pipe member 14 when the first piston moves. The piston 20 of the second set is secured through a bracket 26 to the rear end of the movable pipe member 14.

Reference numeral 30 indicates a conveyor device including a gripper 31 connected to the forward end of the movable pipe member 14, a gripper operating cylinder 32 connected to the rear end of the pipe member 14 through the bracket 26, and a piston rod 33 extending through the pipe member and connected to the gripper 31. The conveyor device 30 is moved in the forward and rearward directions along with the movable pipe member 14. The gripper 31 is in open state when the piston 49, 33 is moved in the forward direction and grips the casting immediately after the gripper 33 engages with the casting. The gripper releases the casting at a suitable position in the rearward movement of the piston rod 33.

Figure 5:
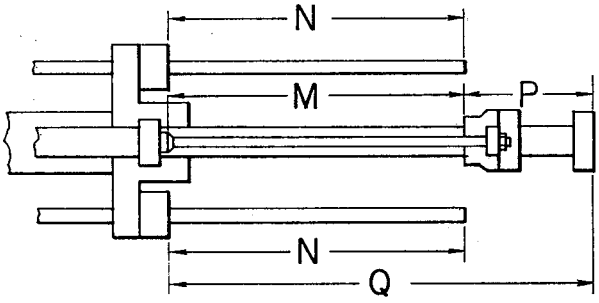
FIGS. 5 and 6 show partial plan views for explaining the stroke ratio of the first and second hydraulic cylinders.
Figure 6:
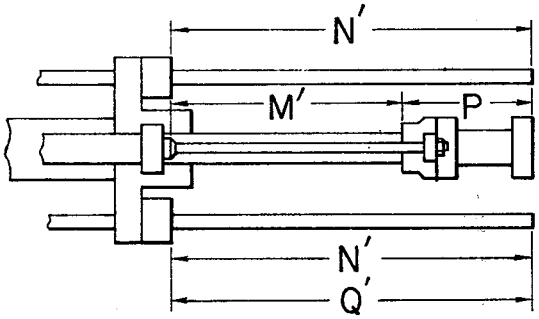

The movable pipe member 14 is assumed to be at rest in the rearmost position as shown in FIG. 3. First, the second cylinder and piston set is operated to move the pipe member 14 in the forward direction until the piston 20 reaches the end of its stroke. Then, the first cylinder and piston set is operated to move the connection pipe member 21 in the forward direction, carrying along with it the second cylinder 19 and the movable pipe member 14, until the piston 17 reaches the end of its stroke. The total stroke L of the movable pipe member 14, that is, the stroke required to remove the casting from the die casting machine, may be determined from the sum of the first set stroke N and the second set stroke M. For convenience of illustration, the stroke N of the first set and the stroke M of the second set are assumed to be the length of the support rods 24, 25, and the exposed length of the movable pipe member 14 in its rearmost position, respectively, as shown in FIG. 5. Assuming that the strokes N and M are equal, the sum Q of the stroke N or M and the length P of the cylinder 32 is $Q = N + P$ or $Q = M + P$. In the arrangement of FIG. 6, however, it is seen that $M' + N' = L$, where $M' < N'$; $M' + P = N'$; and $Q' = N' = M' + P$. Consequently, properly selecting the stroke ratio of the first and second sets in the condition where $Q > Q'$ results in decreasing the space requirements of the apparatus by a length of $Q - Q'$ in comparison with the structure of FIG. 5. The ratio of the stroke M' of the second set to the stroke N' of the first set to minimize the space is, although dependent on the length P of the cylinder 32, about 2:3.

Preferably, the conveyor mechanism 30 of the product removing machine is inclined from 5 to 20 degrees relative to the horizontal. The reasons for this are as follows:

(1) Most of the existing die casting machines have their tie bars arranged in a square configuration as shown in FIG. 2.

(2) Although the pouring hole 7' may be located in the center of the tie bars as indicated by the dotted line in FIG. 2, it is frequently located in the offset position shown by the solid line. Normally, the pouring hole 7 is located below the pouring hole 7' and the distance therebetween is ½ or more of the distance between the tie bars.

(3) Since the product gripping and conveying mechanism will come into contact with the tie bar when it is excessively inclined, the inclination angle of the machanism must take such contact into consideration. The optimum inclination angle is about 8 degrees.

(4) The die casting machine molds are closed for producing the next casting after a casting has been removed. If the removal stroke is too short, the removed casting will come into contact with the core assembly 9. The casting should be removed out of the die as far as possible to prevent this, but on the other hand it is preferable to keep the removal stroke as short as possible in order to maximize productivity speed. In order to satisfy these conflicting conditions, it is important to shorten the casting removal stroke and at the same time prevent the casting from contacting the core assembly or other projections of the die casting machine during the closing of the molds. An inclination angle of the mechanism in the range of 5 to 20 degrees, and preferably about 8 degrees, has been found to yield the best results in terms of sufficient casting removal clearance and high casting production rate. Further, the support frame of the apparatus 10 is constructed of two or more members, so that the gripping and conveying mechanism may be adjustably inclined in the stepped manner within the above range.

FIGS. 7–10 relate to a product turning device 40 particularly suitable for expanding the applications of the product removing apparatus of the present invention, although it is not essential for the proper operation thereof. Briefly, the product turning device 40 comprises a grooved connection pipe member 21' fixed to the second cylinder 19, a projection 47 integrally formed with the movable pipe member 14', a cylindrical member 41 rotatably engaged with the rear portion of the connection pipe member 21', and a driving means 50.

Figure 9A:
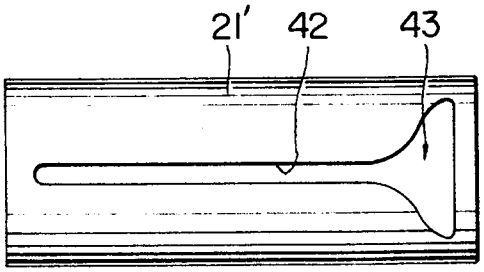
FIG. 9*a* shows a plan view of a grooved connection pipe member.
Figure 9B:
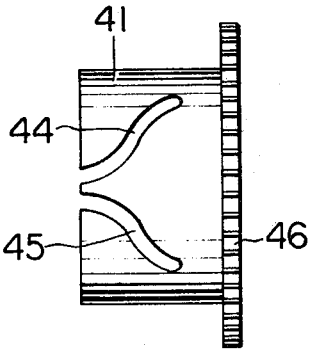
FIG. 9*b* shows a plan view of a grooved rotary member.

As best seen in FIG. 9*a*, the connection pipe member 21' is formed with a longitudinal cam groove 42 and in its rear portion with a substantially triangular cam groove 43 connected to the groove 42. The width of the triangular groove 43 gradually increases in the rearward direction to spread over an angle of at least 90°, and is symmetrical relative to the longitudinal groove 42. As shown in FIG. 9*b*, the cylindrical member 41 is formed with two symmetrically separated spiral cam grooves 44 and 45 which correspond to the outline of the triangular cam groove 43 when the member 41 is in engagement with the connection pipe member 21'. A pinion 46 is secured to the rear end of the cylindrical member 41 for rotation together therewith. The driving means 50 may comprise a hydraulic cylinder and piston set, its cylinder 51 being secured to the apparatus frame (not shown) and its piston 52 being provided with a rack 53 in mesh with the pinion 46 for selectively rotating the member 41 in a clockwise or counter-clockwise direction so as to connect either of the spiral cam grooves 44 or 45 with the longitudinal cam groove 42. The movable pipe member 14' is formed with a projection 47 which rides in the longitudinal cam groove 42 and the selected spiral cam groove 44 or 45. As needed, the member 41 can be turned with the projection 47 maintained in engagement with the rear end of the selected spiral cam groove and moving along the rear or wide edge of the triangular cam groove 43.

Upon removing the casting from the die casting machine and conveying it to a predetermined place, the projection 47 runs along the longitudinal cam groove, and thereafter is guided into the selected spiral cam groove 44 or 45 and moved along one inclined cam face of the triangular cam groove 43 to turn the movable pipe member 14', so that the removed casting is thereby rotated to a predetermined position. The drive means can also be operated to turn the gripper somewhat upon the removal of the casting from the die casting machine.

Consequently, the operation of the driving means 50 to selectively connect either of the two symmetrical spiral cam grooves 44 or 45 to the longitudinal cam groove 42 permits the casting to be turned in a desired direction upon the removal thereof from the die casting machine. Further, as needed, the driving means 50 can be operated with the casting removed to turn the member 41 in a desired direction by selecting one spiral cam groove to move the projection 47 along the rear edge of the triangular cam groove 43 from one end to the other. This permits the casting to be turned or manipulated in a reverse direction.

Figure 10:
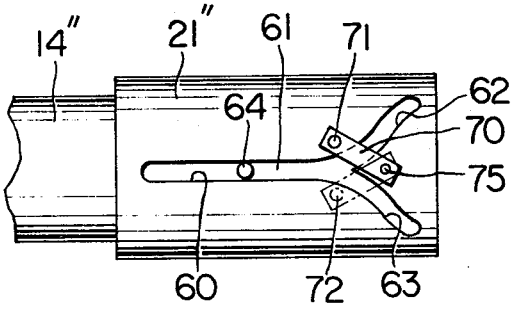
FIG. 10 shows a plan view of an alternative grooved connection pipe.

FIG. 10 shows an alternative embodiment of the product turning mechanism. The connection pipe member 21'' is secured through the front and rear brackets 22 and 23 to the second cylinder 19 in parallel therewith, and supports the movable pipe member 14'' for sliding movement therein. The connection pipe member 21'' is longer than the total stroke of the second piston rod 20 and is formed with a Y-shaped cam groove 60. The groove 60 comprises a longitudinal cam groove 61 whose length corresponds to the stroke required to remove and convey the casting, and symmetrically bifurcated spiral cam grooves 62 and 63 joined to the rear end of the longitudinal cam groove 61. The movable pipe member 14'' is formed with an integral projection 64 which runs in the Y-shaped cam groove 60.

Reference numeral 70 designates a stopper plate having one end pivotally mounted by a pin or screw 75 to the connection pipe member 21'' between the bifurcated grooves 62 and 63. Holes 71 and 72 are provided outside the grooves 62 and 63, at each of which the other end of the stopper plate 70 may be detachably mounted by a pin or screw to the connection pipe member 21'' so that the stopper plate 70 can close one of the grooves 62 or 63 and open the other one to the longitudinal cam groove 61.

In removing the casting from the die casting machine and conveying it to a desired location, the projection 64 runs along the longitudinal cam groove 61 in a rearward direction, and thereafter is led into the opened spiral groove whereby the movable pipe member 14'' is turned in a predetermined direction to rotate the casting as desired. If the turning direction is limited due to the configuration of the casting or the core assembly position the stopper plate 70 may be released and pivoted over to the other hole so that the one groove is closed and the other is opened to the longitudinal cam groove. Thereby, the removing pipe member 14'' is turned in the reverse direction and the casting is placed in a reversed position.

In summary, the invention provides an apparatus for removing a hot casting from a die casting machine and transporting it to a desired location in which the total stroke required to remove and carry the casting is borne by a plurality of hydraulic cylinder and piston sets connected in series and arranged in parallel with each other. This configuration reduces the space requirements of the apparatus and the operation time required, and permits the use of a high speed die casting machine to thereby increase the productivity rate. The apparatus including a movable pipe member inclined from 5 to 20° to prevent the casting from striking obstacles, such as a core assembly, without the need of a complicated gripping mechanism adapted to move up and down. This permits an expanded application of the product removing apparatus. The utility of the apparatus may also be increased by the addition of a turning device adapted to rotate the casting in a desired direction to further prevent it from striking any obstacles during removal.

What is claimed is:

1. An apparatus for removing a casting from a die casting machine and carrying it to a desired site, comprising:

(a) a conveyor assembly including a rod member, a gripper connected to the forward end of said rod member for gripping and releasing the casting, and means connected to the rear end of said rod member for opening and closing said gripper;

(b) a driving means, (c) a movable carriage mounting said driving means and said conveyor assembly, and (d) said driving means including a plurality of hydraulic cylinder and piston sets connected for operation in a series manner and structurally disposed in parallel with each other and with said rod member for reciprocatingly driving said rod member toward and away from a die casting machine, said driving means further comprising a first cylinder and piston set having its cylinder mounted on said movable carriage and a second cylinder and piston set having its cylinder connected to the piston rod of said first set for movement therewith and its piston rod connected to the rear end of said rod member.

2. An apparatus as set forth in claim 1, wherein said rod member is inclined at an angle of from 5 to 20 degrees relative to a horizontal plane.

3. An apparatus as set forth in claim 2, wherein the means for opening and closing said gripper comprises a third cylinder and piston set, said third cylinder being secured to the rear end of said rod member and said third piston rod extending through said rod member to engage said gripper.

4. An apparatus as set forth in claim 3, further comprising means for selectively rotating said rod member and gripper, together with an engaged casting, including a guide cylinder slidingly surrounding said rod member, a Y-shaped cam groove defined in said guide cylinder, and a follower post upstanding from said rod member and slidingly engaged within said groove.

5. An apparatus for removing a casting from a die casting machine and carrying it to a desired site, comprising:

(a) a conveyor assembly including a rod member, said rod member being inclined at an angle of from 5 to 20° relative to a horizontal plane, a gripper connected to the forward end of said rod member for gripping and releasing the casting, and means connected to the rear end of said rod member for opening and closing said gripper;

(b) driving means including a plurality of hydraulic cylinder and piston sets connected for operation in a series manner and structurally disposed in parallel with each other and with said rod member for reciprocatingly driving said rod member toward and away from a die casting machine, said driving means comprising:

a first cylinder and piston set having its cylinder mounted on said movable carriage, and a second cylinder and piston set having its cylinder connected to the piston rod of said first set for movement therewith and its piston rod connected to the rear end of said rod member, and wherein the means for opening and closing said gripper comprises a third cylinder and piston set, the third cylinder being secured to the rear end of said rod member and said third piston rod extending through said rod member to engage said gripper, and (c) a movable carriage mounting said driving means and said conveyor assembly, (d) means for selectively rotating said rod member and gripper, together with an engaged casting, including a guide cylinder slidingly surrounding said rod member, a Y-shaped cam groove defined in said guide cylinder, and a follower post upstanding from said rod member and slidingly engaged within said groove, and (e) stopper means pivotally mounted on said guide cylinder adjacent the crotch of said cam groove for selectively blocking one of the diverging arms of said cam groove.

6. An apparatus for removing a casting from a die casting machine and carrying it to a desired site, comprising:

(a) a conveyor assembly including a rod member, said rod member being inclined at an angle of from 5 to 20° relative to a horizontal plane, a gripper connected to the forward end of said rod member for gripping and releasing the casting, and means connected to the rear end of said rod member for opening and closing said gripper;

(b) driving means including a plurality of hydraulic cylinder and piston sets connected for operation in a series manner and structurally disposed in parallel with each other and with said rod member for reciprocatingly driving said rod member toward and away from a die casting machine, said driving means comprising:

a first cylinder and piston set having its cylinder mounted on said movable carriage, and a second cylinder and piston set having its cylinder connected to the piston rod of said first set for movement therewith and its piston rod connected to the rear end of said rod member, and wherein the means for opening and closing said gripper comprises a third cylinder and piston set, the third cylinder being secured to the rear end of said rod member and said third piston rod extending through said rod member to engage said gripper, and (c) a movable mounting said driving means and said conveyor assembly, (d) means for selectively rotating said rod member and gripper, together with an engaged casting, including a guide cylinder slidingly surrounding said rod member, a Y-shaped cam groove defined in said guide cylinder, and a follower post upstanding from said rod member and slidingly engaged within said groove, and (e) wherein the triangular space between the diverging arms of said cam groove is open, and further comprising a rotary member surrounding said guide cylinder and overlying said triangular space, a pair of diverging cam grooves defined in said rotary member, and means for selectively and bidirectionally rotating said rotary member.

* * * * *